US006156137A

United States Patent [19]

Lundstrom et al.

[11] Patent Number: 6,156,137

[45] **Date of Patent: *Dec. 5, 2000**

[54] GAS GENERATIVE COMPOSITIONS

[75] Inventors: Norman H. Lundstrom, Manassas; Robert S. Scheffee, Lorton; Aaron J. Gresco, Culpeper, all of Va.

[73] Assignee: Atlantic Research Corporation, Gainesville, Va.

[ * ] Notice: This patent is subject to a terminal disclaimer.

[21] Appl. No.: 09/434,492

[22] Filed: Nov. 5, 1999

[51] Int. Cl.[7] ..... C06B 31/00; C06B 33/00; C06B 45/10; B60R 21/28

[52] U.S. Cl. ..... 149/45; 149/19.1; 149/19.5; 149/37; 280/741; 280/740

[58] Field of Search ..... 149/19.1, 37, 19.5, 149/45

[56] References Cited

U.S. PATENT DOCUMENTS

| | | | |
|---|---|---|---|
| 3,609,115 | 9/1971 | Sammons | 260/320.4 |
| 3,819,380 | 6/1974 | Baldassarri et al. | 96/76 |
| 4,938,813 | 7/1990 | Eisele et al. | 149/19.2 |
| 5,015,309 | 5/1991 | Wardle et al. | 149/19.1 |
| 5,467,714 | 11/1995 | Lund et al. | 102/284 |
| 5,516,377 | 5/1996 | Highsmith et al. | 149/18 |
| 5,557,062 | 9/1996 | MacLaren et al. | 149/46 |
| 5,589,661 | 12/1996 | Menke et al. | 149/19.4 |
| 5,591,936 | 1/1997 | Willer et al. | 149/19.4 |
| 5,608,183 | 3/1997 | Barnes et al. | 149/45 |
| 5,636,668 | 6/1997 | Barnes et al. | 149/45 |
| 5,670,740 | 9/1997 | Barnes et al. | 149/620 |
| 5,682,014 | 10/1997 | Highsmith | 149/36 |
| 5,693,794 | 12/1997 | Nielsen | 540/554 |
| 5,725,699 | 3/1998 | Hinshaw et al. | 149/19.1 |
| 5,739,325 | 4/1998 | Wardle et al. | 149/92 |
| 5,841,065 | 11/1998 | Mendenhall | 149/37 |
| 5,861,571 | 1/1999 | Scheffee et al. | 102/288 |
| 5,883,330 | 3/1999 | Yoshida | 149/83 |
| 5,898,126 | 4/1999 | Yoshida | 149/46 |
| 5,936,184 | 8/1999 | Majerus et al. | 102/306 |
| 5,970,703 | 10/1999 | Hinshaw et al. | 60/219 |

*Primary Examiner*—Peter M. Poon
*Assistant Examiner*—Glenda L. Sanchez
*Attorney, Agent, or Firm*—Nixon & Vanderhye P.C.

[57] ABSTRACT

Gas generative compositions especially useful in inflators for protective passive restraint devices (e.g., motor vehicle air bags, escape slide chutes, lift rafts, and the like) include a nitrogen-containing fuel and an oxidizer selected from copper (II) oxide (CuO), cupric nitrate, basic copper nitrate ($Cu(NO_3)_2.3Cu(OH_2)$, strontium nitrate ($Sr(NO_3)_2$) and mixtures thereof. Most preferably the nitrogen-containing fuel is azodicarbonamidine dinitrate (AZODN) and/or 2,4,6,8,10,12-hexanitro-2,4,6,8,10,12-hexaazaisowurtzitane (CL-20). The compositions of the present invention provide high burning rates with acceptable burning rate pressure exponents which allow their operation at lower pressures, thereby resulting in the use of less costly, lower weight, and lower strength materials for design and manufacture of the inflator pressure vessel.

16 Claims, 1 Drawing Sheet

GAS GENERATIVE COMPOSITIONS

FIELD OF THE INVENTION

The present invention relates generally to inflators for devices such as protective passive restraints or air bags used in motor vehicles, escape slide chutes, life rafts, and the like. More particularly, the present invention relates to gas generative compositions which exhibit low insoluble combustion products.

BACKGROUND AND SUMMARY OF THE INVENTION

Many devices, such as protective passive restraints or air bags used in motor vehicles, escape slide chutes, life rafts, and the like, are normally stored in a deflated state and are inflated with gas substantially instantaneously at the time of need. Such devices are generally stored and used in close proximity to humans and, therefore, must be designed with a high safety factor which is effective under all conceivable ambient conditions.

Inflation is sometimes accomplished solely by means of a gas generative composition. At other times, inflation is accomplished by means of a gas, such as air, nitrogen, carbon dioxide, helium, and the like, which is stored under pressure and further pressurized and supplemented at the time of use by the addition of high temperature combustion gas products produced by the burning of a gas-generative composition.

It is, of course, critical that the gas-generative composition be capable of safe and reliable storage without decomposition or ignition at temperatures which are likely to be encountered in a motor vehicle or other storage environment. For example, temperatures as high as about 107° C. (225° F.) may reasonably be experienced. It is also important that substantially all the combustion products generated during use be non-toxic, non-corrosive, non-flammable, particularly where the inflator device is used in a closed environment, such as a passenger compartment of a motor vehicle.

Broadly, the present invention is directed toward gas generative compositions which exhibit low concentrations of insoluble combustion products. In this regard, the gas generative compositions of the present invention are embodied in a solid mixture of a nitrogen-containing fuel and an oxidizer selected from oxides of copper, nitrates of copper and strontium, and mixtures thereof. Most preferably, the nitrogen-containing fuel is azodicarbonamidine dinitrate (AZODN) and/or 2,4,6,8,10,12-hexanitro-2,4,6,8,10,12-hexaazaisowurtzitane, colloquially known in the art as "CL-20". The oxidizer is most preferably copper (II) oxide (CuO) and/or basic copper nitrate (also known as copper trihydroxynitrate ($Cu(NO_3)$hd 2.3$Cu(OH_2)$ and/or strontium nitrate ($Sr(NO_3)_2$).

It has been discovered that the compositions of the present invention provide high burning rates with acceptable burning rate pressure exponents which allow their operation at lower pressures, thereby resulting in the use of less costly, lower weight, and lower strength materials for design and manufacture of the inflator pressure vessel. In accordance with this invention, the use of nitrate and perchlorate salts of azodicarbonamidine, and in particular azodicarbonamidine dinitrate, or hexanitrohexaazaisowurtzitane (CL-20) and mixtures thereof, in combination with oxidizers such as copper oxide, basic copper nitrate, strontium nitrate or mixtures thereof, and optionally a binder for providing structural integrity, results in heterogeneous propellant compositions which provide greater total gas output and a lower concentration of insoluble solid combustion products, than when such oxidizers are used with prior art fuels such as guanidine nitrate, aminoguanidine nitrate, nitroguanidine, ethylenediamine dinitrate, cyclotrimethylenetrinitramine (RDX), cyclotetramethylenetetranitramine (HMX), and various tetrazole derivatives, such as 5-aminotetrazole, diammonium bitetrazole, and potassium 5-aminotetrazole.

As discussed above and in accordance with the present invention, a distinct advantage results from the use of azodicarbonamidine dinitrate (AZODN) and/or hexanitrohexaazaisowurtzitane (CL-20) as the major fuel component because the nitric acid salt of azodicarbonamidine, and CL-20, have a significantly better oxygen balance as compared to conventional fuels. This improved oxygen balance thereby allows the use of a significantly lower concentration of oxidizer to maintain the proper stoichiometry for burning to substantially innocuous gaseous combustion products consisting of carbon dioxide, nitrogen, and water vapor. In addition, because a lower concentration of solid oxidizer is required, an associated lower concentration of substantially insoluble and clinkerable solid combustion products are formed when compared with prior art formulations. Because a lower total concentration of solid combustion products is formed, acceptable filtration of the solid products which do not clink and are not trapped in the combustion chamber is readily achieved by using fewer mechanical screens or other filtering media within the inflator, and still retain a lowered susceptibility for initiating an asthmatic reaction from the occupant of the vehicle.

The gas generant compositions of this invention are particularly useful when employed in inflatable passive vehicle occupant restraint systems (e.g., air bag systems). Thus, the compositions of this invention may be employed as a monopropellant, fuel or partial fuel ingredient for use in hybrid inflation systems, airbag propellants, multiple airbag propellant combinations, ignition mixtures, and auto ignition pill (AIP) compositions.

These and other aspects and advantages of the present invention will become more clear after careful consideration is given to the following detailed description of the preferred exemplary embodiments thereof.

BRIEF DESCRIPTION OF THE ACCOMPANYING DRAWING

FIG. 1 depicts the ballistic pressure-time traces for a solid pyrotechnic gas generant composition identified as C1 in Table 2 below.

DETAILED DESCRIPTION OF THE INVENTION

Figure 1:
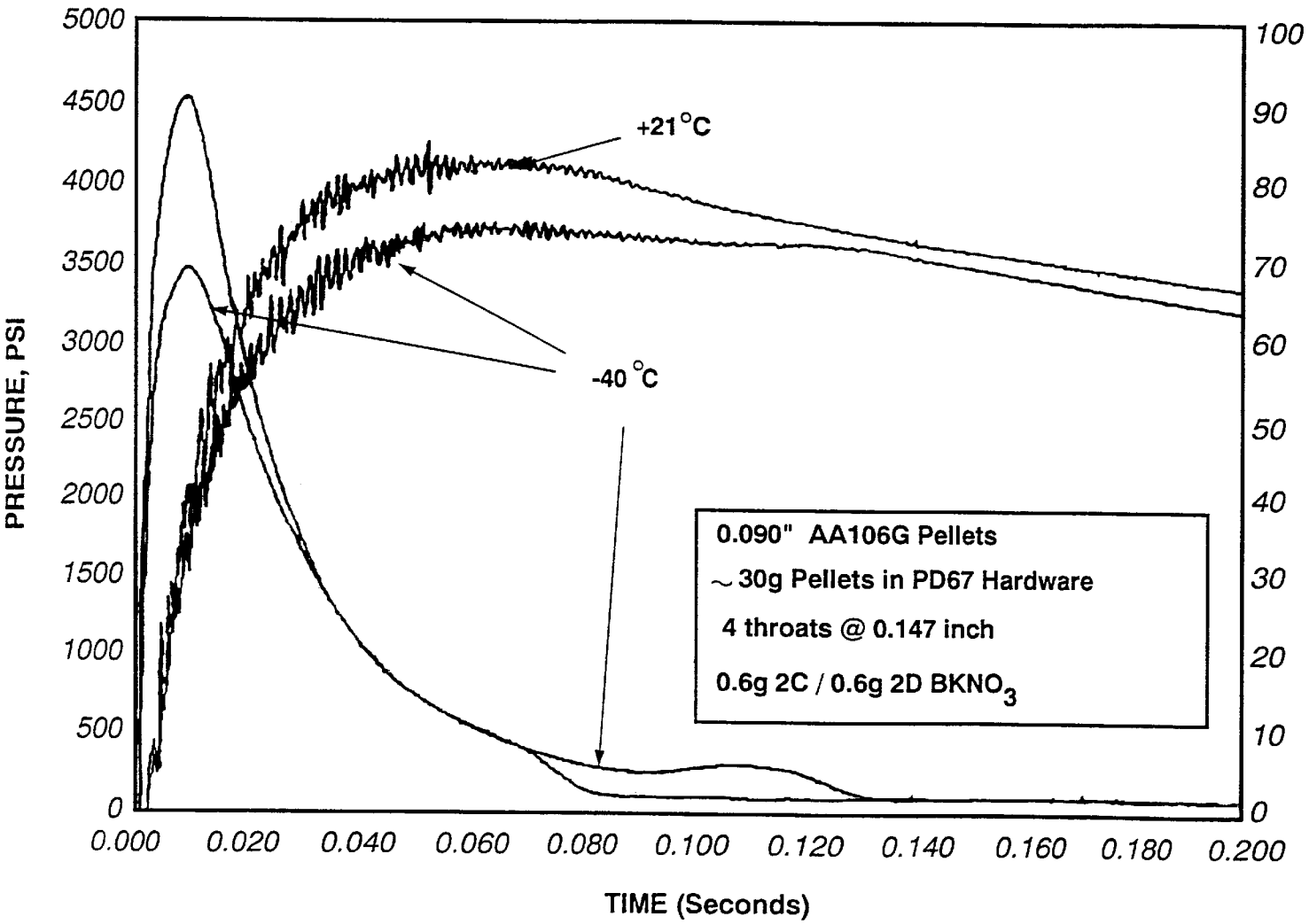

The compositions of the present invention will necessarily include a nitrogen containing fuel. Most preferably, the fuel is AZODN, CL-20 or a mixture thereof. The fuel will be present in the compositions of this invention in an amount between about 5 wt. % to about 95 wt. %, and more preferably between about 50 wt. % to about 90 wt. %.

The compositions of the present invention will also contain an oxidizer selected from copper (II) oxide (CuO), cupric nitrate, basic copper nitrate ($Cu(NO_3)_2.3)Cu(OH)_2$), strontium nitrate ($Sr(NO_3)_2$) and mixtures thereof. The oxidizer will be present in the compositions of this invention in an amount between about 10 wt. % to about 60 wt. %, and more preferably between about 20 wt. % to about 60 wt. %.

Virtually any additive conventionally employed in gas generant compositions, such as binders, processing aids, ballistic additives, burn rate catalysts, colorants, slag formers, auxiliary oxidizers, multiple fuels and the like may be employed in the compositions of this invention.

Examples of auxiliary oxidizers include non-metallic, alkali metal, alkaline earth metal, lanthanide, rare earth, transition metal, and transition metal complex nitrates, nitrites, perchlorates, chlorates, chlorites, oxides, peroxides, superoxides, carbonates, hydroxides, sulfates, persulfates, permanganates, chromates, dichromates, and mixtures thereof. One specific example of a transition metal complex oxidizer includes hexammine cobalt (III) nitrate.

Examples of auxiliary fuels which may be utilized include derivatives and salts of guanidine, amino guanidine, diaminoguanidine triaminoguandine, triazines, triazoles, tetrazoles, bitetrazoles, azotetrazoles, amines, polyamines, linear and cylic nitramines, amides, polyamides such as azodicarbonamide, hydrazides, tetrazines such as 3,6-dihydrazino-s-tetrazines and mixtures thereof. An example of a triazine include trihydrazinotriazine.

The compositions of this invention may be uncatalyzed (i.e., the composition is void of a combustion catalyst), or may be catalyzed. That is, the composition may include a combustion catalyzing effective amount of a combustion catalyst. One preferred combustion catalyst that may be employed in the compositions of this invention is copper phthalocyanine (CuP). If used, the catalyst will preferably be present in a range between about 0.1 wt. % to about 5.0 wt. %.

The compositions may be used in the form of powders, granules, grains or compression-molded pellets. The compositions are most preferably used in the form of a solid compression-molded mixture of the above-noted components. In this regard, the compositions will therefore most preferably include a polymeric binder in an amount sufficient to bind the components into a solid form (e.g., pellet). The binder will therefore typically be present in an amount, based on the total composition weight, of between about 1.0 to about 6.0 wt. %, and preferably between about 2.0 to about 4.0 wt. %. Examples of binders include polyvinyl acetate (PVAC), cellulose acetate butyrate (CAB), and poly (alkylene carbonates). The preferred binders are those poly (alkylene carbonates) commercially available from Pac Polymers, Inc. As Q-PAC® 40, a poly(propylene carbonate) copolymer, and AQ-PAC® 25, a poly(ethylene carbonate) copolymer, or mixtures thereof.

The present invention will be further understood from the following non-limiting Examples.

EXAMPLES

Example 1

Basic copper nitrate (copper trihydroxy nitrate) was combined with each of the fuel components noted below in Table 1 to obtain binary compositions. Theoretical calculations were conducted for the binary compositions of Table 1 at a combustion pressure of 5000 psia and an oxidation ratio of 0.95. The results are summarized in Table 1.

In Table 1 below, the following abbreviations were employed:

PVAC=polyvinyl acetate

CAB=cellulose acetate butyrate

QPAC=poly(alkylene carbonate)

5-AT=5-aminotetrazole

GN=guanidine nitrate

AZODN=azodicarbonamidine dinitrate

TABLE 1

| Sample | Binder and/or Fuel | Amt. (wt. %) | $T_C$, ° K. | Gas, m/cwt | Ash, wt. % |
|---|---|---|---|---|---|
| A | PVAC | 15.152 | 1542 | 2.0653 | 44.9 |
| B | CAB | 17.669 | 1544 | 2.0200 | 43.6 |
| C | QPAC | 20.704 | 1488 | 2.0606 | 42.0 |
| D | 5-AT | 32.773 | 2023 | 3.4795 | 35.6 |
| E | GN | 57.067 | 1868 | 3.1519 | 22.7 |
| F | AZODN | 74.091 | 2575 | 3.2897 | 13.7 |

All of the ash in the compositions noted in Table 1 above is elemental copper because it is not a strong enough reducing agent to reduce either $CO_2$ or $H_2O$. As can be seen, Composition F is the best in terms of high gas output, and low ash.

Example 2

Table 2 below provides examples of propellant compositions in accordance with the present invention and some of their respective physical properties.

TABLE 2

COMPOSITION AND PROPERTIES OF HIGH BURNING RATE AZODN GAS GENERATOR PROPELLANTS

| | C1 | C2 | C3 |
|---|---|---|---|
| Composition, Wt % | | | |
| Azodicarbonamidine Dinitrate | 68.66 | 60.15 | 67.00 |
| Strontium Nitrate | 28.34 | — | — |
| Copper (II) Oxide | — | 39.85 | — |
| Basic Copper Nitrate | — | — | 31.00 |
| Polyalkylene Carbonate Binder | 3.00 | — | 2.00 |
| Combustion Products: | | | |
| Gaseous Reaction Products | 83.70 | 72.30 | 83.00 |
| Moles of Gas per 100 gms: | 3.5 | 2.7 | 3.1 |
| Solid Reaction Products: | 16.30 | 27.70 | 17.00 |
| Ballistic Properties: | | | |
| Burning Rate, 1000 psi, ips | 0.50 | 0.80 | 0.64 |
| Pressure Exponent, n: | 0.48 | 0.63 | 0.51 |
| Pellet Crush Strength Studies: | | | |
| Baseline, stress, psi: | 3948 | — | 3827 |
| Age at 107° C., 400 Hrs, psi | 3107 | 3703 | — |
| Temp. Cycling, 200 cycles, -40/107° C., psi | 5258 | 4082 | — |
| Hazards Properties: | | | |
| Threshold | Green Line | Green Line | Green Line |
| Impact: | >45 kgcm | >50 kgcm | >45 kgcm |
| Friction, ABL: | Neg > 100 psi @90° | Neg > 1800 psi @90° | Neg > 100 psi @90° |
| Electrostatic Discharge; | Neg > 1.4 Joules | Neg > 6 Joules | Neg > 1.4 Joules |

FIG. 1 shows the ballistic pressure-time results for the solid pyrotechnic gas generant composition consisting of azodicarbonamidine dinitrate, strontium nitrate, and polyalkylene carbonate binder identified as composition C1 in Table 2 above when evaluated in an "all pyro" PD-67 inflator unit (Atlantic Research Corporation, Gainesville, Va.) at ambient (−21° C.) and low temperature (−40° C.) conditions. It will be observed that the propellant provides the desired results with regard to the time of ignition, action time, inflator pressure, tank pressure, rate of gas production, and total gas production.

While the invention has been described in connection with what is presently considered to be the most practical and preferred embodiment, it is to be understood that the invention is not be limited to the disclosed embodiment, but on the contrary, is intended to cover various modifications and equivalent arrangements included within the spirit and scope of the appended claims.

What is claimed is:

1. A gas generative composition which comprises a solid mixture of a nitrogen-containing fuel comprising azodicarbonamidine dinitrate and an oxidizer selected from copper (II) oxide, cupric nitrate, basic copper nitrate, strontium nitrate, and mixtures thereof.

2. The gas generative composition of claim 1, wherein the nitrogen-containing fuel further comprises 2,4,6,8,10,12-hexanitro-2,4,6,8,10,12-hexaazaisowurtzitane.

3. The gas generative composition of claim 1 or 2, wherein the oxidizer is present in an amount between about 10 wt. % to about 60 wt. %.

4. The gas generative composition of claim 3, wherein the fuel is present in an amount between about 5 wt. % to about 95 wt. %.

5. The gas generative composition of claim 1 or 2, wherein the oxidizer is present in an amount between about 20 wt. % to about 60 wt. %.

6. The gas generative composition of claim 5, wherein the fuel is present in an amount between about 50 wt. % to about 90 wt. %.

7. The gas generative composition as in claim 6, further comprising a binder material.

8. The gas generative composition as in claim 7, wherein the binder material is a poly(alkylene carbonate).

9. The gas generative composition as in claim 8, wherein the binder material is a poly(propylene carbonate) and/or poly(ethylene carbonate).

10. The gas generative composition of claim 7, wherein the binder material is present in an amount between about 1.0 to about 6.0 wt. %.

11. A gas generative composition comprising a solid mixture of:

between about 50 to about 90 wt. % of azodicarbonamidine dinitrate;

between about 20 to about 60 wt. % of an oxidizer which is at least one selected from the group consisting of copper (II) oxide, cupric nitrate, basic copper nitrate and strontium nitrate; and between about 1.0 to about 6.0 wt. % of a poly(alkylene carbonate) binder material.

12. The gas generative composition of claim 11, wherein the binder material is a poly(propylene carbonate) and/or poly(ethylene carbonate).

13. The gas generative composition of claim 1 or 11, further comprising a combustion catalyst.

14. The gas generative composition of claim 13, wherein the combustion catalyst is copper phthalocyanine.

15. The gas generative composition of claim 14, wherein the combustion catalyst is present in an amount between about 0.1 to about 5.0 wt. %.

16. An inflator for a protective passive restraint device which comprises a gas generative composition as in claims 1 or 11.

* * * * *

UNITED STATES PATENT AND TRADEMARK OFFICE

CERTIFICATE OF CORRECTION

PATENT NO. : 6,156,137
DATED : December 5, 2000
INVENTOR(S) : Norman H. LUNDSTROM et al It is certified that error appears in the above-identified patent and that said letters patent is hereby corrected as shown below:

Title Page, Item No. 75 [Inventors], change Aaron J. Gresco to: - Aaron J. Greso -

Signed and Sealed this

Twenty-second Day of May, 2001

*Attest:*

NICHOLAS P. GODICI

*Attesting Officer*

*Acting Director of the United States Patent and Trademark Office*